US008284145B2

(12) United States Patent
Zheng

(10) Patent No.: US 8,284,145 B2
(45) Date of Patent: Oct. 9, 2012

(54) LIQUID CRYSTAL DISPLAY DRIVER AND LIQUID CRYSTAL DISPLAY DRIVING METHOD FOR IMPROVING BRIGHTNESS UNIFORMITY

(75) Inventor: Jia-Chi Zheng, Yilan County (TW)

(73) Assignee: Sitronix Technology Corp., Hsinchu Hsien (TW)

( * ) Notice: Subject to any disclaimer, the term of this patent is extended or adjusted under 35 U.S.C. 154(b) by 913 days.

(21) Appl. No.: 11/963,521

(22) Filed: Dec. 21, 2007

(65) Prior Publication Data

US 2009/0160750 A1 Jun. 25, 2009

(51) Int. Cl.
*G09G 3/36* (2006.01)
*G09G 5/10* (2006.01)

(52) U.S. Cl. ..... 345/98; 345/94; 345/690; 345/89

(58) Field of Classification Search ..... 345/94, 345/98, 89, 690
See application file for complete search history.

(56) References Cited

U.S. PATENT DOCUMENTS 5,841,416 A * 11/1998 Mano et al. ..... 345/94
6,633,272 B1 10/2003 Kumagawa et al.

FOREIGN PATENT DOCUMENTS

JP 5-265402 A 10/1993

* cited by examiner

*Primary Examiner* — Amr Awad
*Assistant Examiner* — Randal Willis
(74) *Attorney, Agent, or Firm* — Rosenberg, Klein & Lee

(57) ABSTRACT

The present invention discloses an LCD driver and LCD driving method for improving brightness uniformity, wherein a detection-count circuit is used to calculate a number of waiting voltage offsets of each one of data electrodes during a scanning period, convert the number of waiting voltage offsets into an offset time, shift a data electrode to an intermediate potential during the offset time, and shift the data electrode to a potential for a next piece of data after the offset time is completed. Thereby, the present invention can reduce LCD brightness non-uniformity and promote LCD quality.

4 Claims, 7 Drawing Sheets

LIQUID CRYSTAL DISPLAY DRIVER AND LIQUID CRYSTAL DISPLAY DRIVING METHOD FOR IMPROVING BRIGHTNESS UNIFORMITY

FIELD OF THE INVENTION

The present invention relates to an LCD (Liquid Crystal Display) driver and LCD driving method, particularly to an LCD driver and LCD driving method for improving brightness uniformity.

BACKGROUND OF THE INVENTION

Liquid crystal is a substance having properties between those of a conventional liquid and those of a solid crystal. Liquid crystal has ordered molecular arrangement. When liquid crystal is heated, it becomes a transparent liquid. When liquid crystal is cooled down, it appears like a cloudy solid. As such a substance has properties of liquid and crystal, it assumes the name "liquid crystal". The principle of liquid crystal displays is to apply an electric field to liquid crystal enclosed in a glass casing to change the orientation of crystal liquid molecules and change the optical properties thereof. In cooperation with a polarizer, light transmittance of liquid crystal can thus be changed by an applied electric field.

Refer to FIG. 1 and FIG. 2 respectively a block diagram showing an LCD driver circuit and a block diagram showing a data-electrode driver circuit. An LCD driver generally comprises: a data-electrode driver 14, a scanning-electrode driver 13, a potential generator 12 providing signal potential for the abovementioned drivers, and a controller 11 providing control signals, wherein the data-electrode driver 14 and the scanning-electrode driver 13 are both electrically connected to an LCD panel 15. The controller 11 sends display data, latch pulses (LP), alternating driving signals (M), pulse width modulation signals (PWM), frame rate control signals (FRC) and vertical synchronous signals to the data-electrode driver 14. In the case that the potential generator 12 outputs five different potentials V1, V2, V3, V4 and V5, Potentials V1, V3 and V5 are input to the scanning-electrode driver 13, and Potentials V2 and V4 are input to the data-electrode driver 14. The LCD panel 15 has data electrodes X1, X2, . . . , Xn and scanning electrodes Y1, Y2, . . . , Ym. The intersections of the data electrodes X1, X2, . . . , Xn and the scanning electrodes Y1, Y2, . . . , Ym form LCD pixels.

The abovementioned data-electrode driver 14 has a latch register circuit 141, a switch control circuit 142, a voltage level shifter 143 and a driver output circuit 144. Via horizontal synchronous signals, the latch register circuit 141 temporarily stores display data line by line and sends them to the switch control circuit 142. The switch control circuit 142 processes the alternating driving signals (M), pulse width modulation signals (PWM), frame rate control signals (FRC) and display data into switch control signals. The voltage level shifter 143 converts the digital signals of the switch control signals into switch-control potentials and send the switch-control potentials to the driver output circuit 144. Switch devices 1441 respectively send the switch-control potentials to the data electrodes X1, X2, . . . , Xn to form the data-electrode signals the LCD panel 15 needs. In FIG. 2, the switch device 1441 controlling Potentials V2 and V4 is used for exemplification. Therefore, each switch device 1441 has two switches.

Refer to FIG. 3, FIG. 4 and FIG. 5. Below, a 2×4 liquid crystal matrix is used to exemplify an LCD panel. In a multi-task driving method, vertical synchronous signals sequentially trigger one of the four scanning electrodes Y1~Y4 to select Potentials V1 or V5 each time, and all other scanning electrodes can only have Potential V3. For the data electrode X1 or X2, the pulse width is decided by display data. Then, Potential V2 or V4 is selected according to alternating driving signals. The gray level is decided by the RMS (Root Mean Square) of the voltage difference of the waveforms of the scanning electrode and the data electrode, such as |Y1−X1| or |Y1−X2|.

Refer to FIG. 3. Suppose V2-V3=V3-V4 and V1-V3=V3-V5. When the scanning electrodes Y1 and Y2 are at Potential V3 (non-selection signal), the RMS of the voltage differences of the scanning electrodes Y1 and Y2 and the data electrodes X1 and X2 will be identical in an ideal condition no matter what width the waveforms of the data electrodes X1 and X2 have. In other words, the presented gray level has nothing to do with the waveform width of the data electrodes X1 and X2. When the scanning electrodes Y1.about.Y4 are at Potentials V1 or V5 (selection signal), the pulse width of the data electrodes X1 and X2 will change the RMS. In other words, the pulse width of the data electrodes decides the gray level of pixels. Those described above is the basic principle of a liquid crystal matrix. Refer to FIG. 5(*a*) for the gray levels decided by the abovementioned waveforms. In an ideal condition, the four pixels along the data electrode X1 have the same gray level as the pixel X2-Y 1. The other three pixels along the data electrode X2 have the brightest gray level.

In reality, the data electrodes X1 and X2, the scanning electrodes Y1.about.Y4 and the driver circuit all have resistances, and a capacitance exists between each two electrodes, which will distort the driving waveforms, as shown in FIG. 4. When the scanning electrodes Yl.about.Y4 are at Potential V3, such a case will result in that the data electrodes X1 and X2 will mutually interfere, as shown in FIG. 5(*b*), wherein the pixel Xl-Y1 and the pixel X2-Y1 have different gray levels. Each voltage shift of the data electrode X1 or X2 will decrease the RMS. Thus, what is presented in a pixel is not just decided by the data that the system intends to display but also influenced by the data of the other pixels along the same data electrode X1 or X2. Consequently, brightness non-uniformity appears.

To overcome the abovementioned problem, a Japan patent publication no. 5265402 proposes a solution that the driving waveform of the data electrode X1 or X2 has an offset time during each scanning period. Then, the output is at a potential between the ON-presentation and the OFF presentation. Thus, the shift number of the effective voltage applied on the pixel will not vary with different display data. Thereby, the brightness non-uniformity resulting from waveform distortion can be eliminated. However, such a method has a lower effective voltage and a lower contrast than the conventional driving method because an intermediate potential is output during the offset time, and because each scanning period has an offset time. Increasing bias ratio can solve the problem. However, increasing bias ratio needs increasing output voltage. Thus, power consumption also increases.

To overcome the abovementioned problem, a U.S. Pat. No. 6,633,272 proposes a solution: during the voltage shift of the data electrode X1 or X2, if the data electrode is intended to shift to Potential V2, it is beforehand shifted to a higher potential V2'; if the data electrode is intended to shift to Potential V4, it is beforehand shifted to a lower potential V4', as shown in FIG. 6. The excess effective voltage resulting from beforehand shifting to V2' or V4' can counterbalance the lost effective voltage resulting from the voltage shift of the data electrode X1 or X2. Thereby, the brightness non-uniformity resulting from waveform distortion can be eliminated.

Refer to FIG. 7. Alternatively, when there is no voltage shift of the data electrode X1 or X2 during a scanning period, the data electrode X1 or X2 is shifted to a potential V2' lower than V2 or a potential V4' higher than V4 to reduce the effective voltage of the data electrode without voltage shift and to offset the loss.

The abovementioned conventional technology can reduce effective voltage loss and contrast degradation to the minimum. As the voltage difference between V2' and V2 or between V4' and V4 is small, the current consumed in offset is also not great. However, the abovementioned technology has the disadvantage that the power supply needs two additional offset voltages V2' and V4'. Further, the switch device 1442 of the driver output circuit 144 also needs two additional switches, as shown in FIG. 8. Besides, in LCD, a gray level is usually implemented with a pulse width modulation signal (PWM). Thus, the offset timing and the pulse width are constrained in the abovementioned technology.

SUMMARY OF THE INVENTION

The primary objective of the present invention is to provide an LCD driver and LCD driving method for improving brightness uniformity, which can promote the quality of an LCD panel without using additional offset voltage and without increasing the complexity of the power supply.

Another objective of the present invention is to provide an LCD driver and LCD driving method for improving brightness uniformity, which can promote the quality of an LCD panel with a smaller number of voltage offsets and with less power consumption in data electrodes.

To achieve the abovementioned objectives, the present invention proposes an LCD driver for improving brightness uniformity, which is a data-electrode driver outputting display data to an LCD panel and comprises: a latch register circuit, a switch control circuit, a detection-count circuit, a voltage level shifter and a driver output circuit. The latch register circuit temporarily stores display data line by line and sends them to the switch control circuit. The switch control circuit processes signals into switch control signals. The detection-count circuit detects the switch control signals. When a switch control signal does not change during a scanning period, the detection-count circuit increases the count by one. The detection-count circuit calculates the number of waiting voltage offsets of each data electrode and converts the number of waiting voltage offsets into an offset time and shifts the data electrode to an intermediate potential during the offset time. The voltage level shifter converts the digital switch control signals, which have passed through the detection-count circuit, into signals able to control switches and outputs the signals able to control switches to the driver output circuit. The driver output circuit receives the signals from the voltage level shifter and outputs data-electrode signals via switch devices.

The present invention also proposes an LCD driving method for improving brightness uniformity, wherein a detection-count circuit calculates the number of waiting voltage offsets of each data electrode during a scanning period and converts the number into an offset time and shifts the data electrode to an intermediate potential during the offset time; the offset time is proportional to the number of waiting voltage offsets; after offset is completed, the data electrode is shifted to a potential for the next piece of data.

The present invention can promote the quality of an LCD panel without using additional offset voltage and without increasing the complexity of the power supply. Besides, the number of the switch circuits used in the data electrode of the present invention is less by one than that used in the conventional technology. Further, the present invention can achieve its objectives with a smaller number of voltage offsets and with less power consumption in data electrodes. Furthermore, the present invention can reduce effective voltage loss and contrast degradation to the minimum and can more precisely offset the loss resulting from voltage shifts.

DETAILED DESCRIPTION OF THE PREFERRED EMBODIMENTS

Below, the technical contents of the present invention will be described in detail with embodiments. However, it should be noted that the embodiments are only to exemplify the present invention but not to limit the scope of the present invention.

Figure 9:
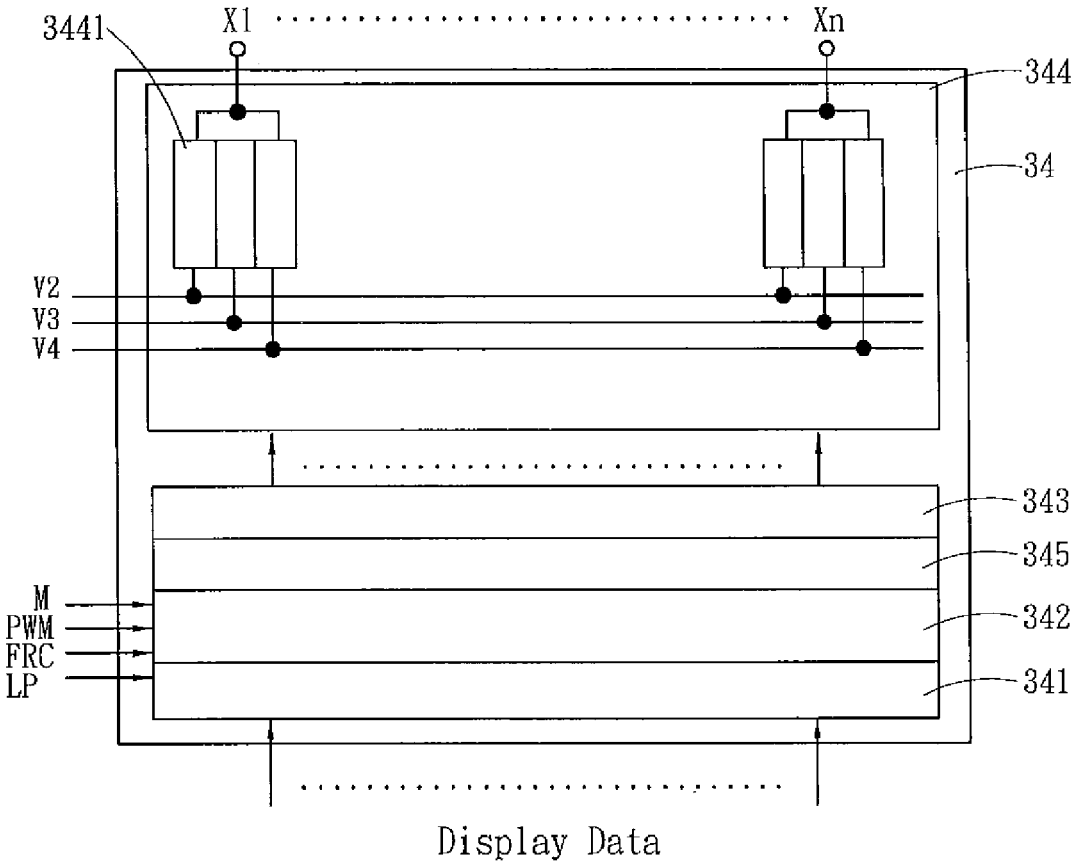
FIG. 9 is a block diagram showing a data-electrode driver according to the present invention.
Figure 10:
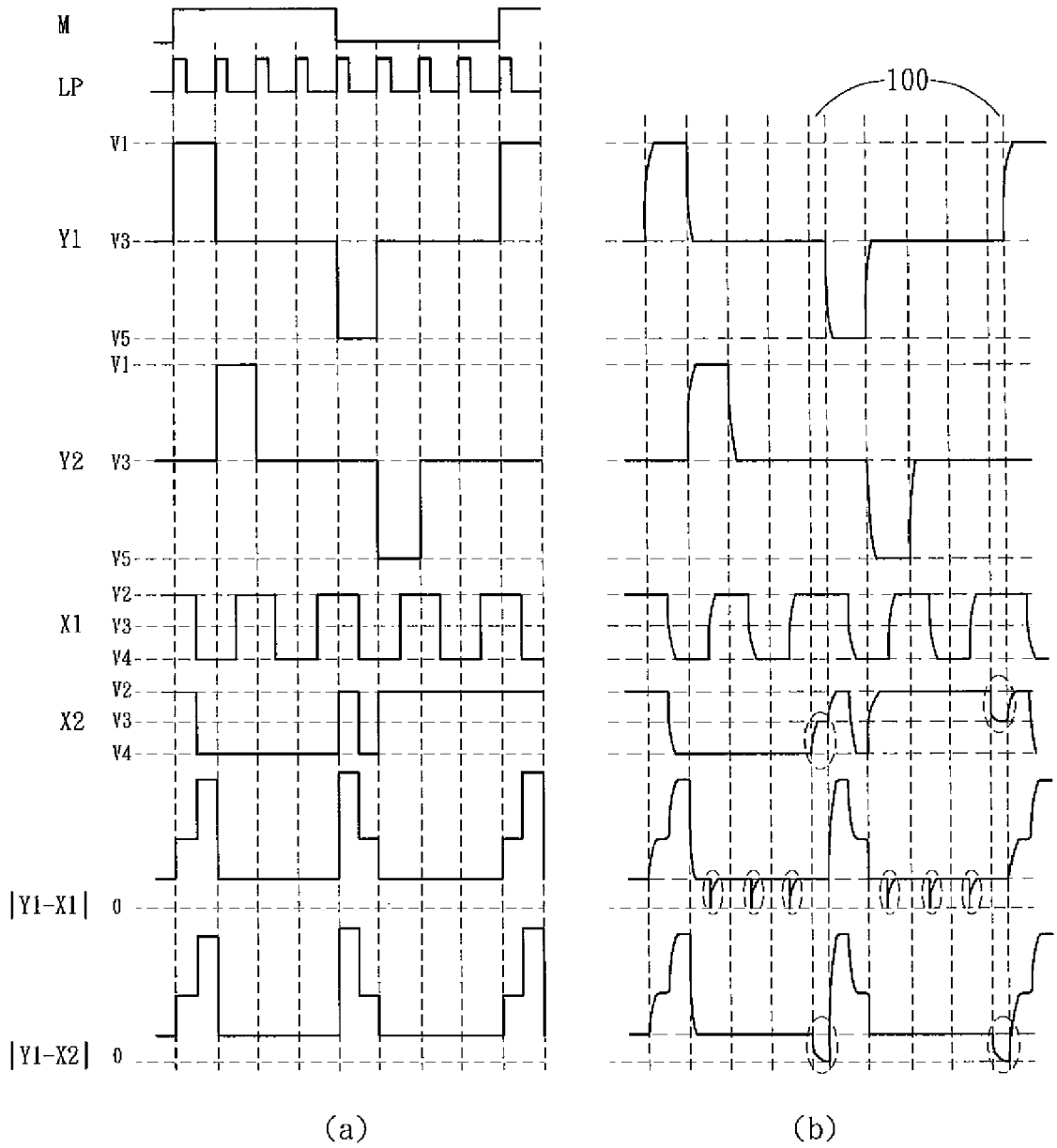
FIG. 10 is a diagram showing a timing diagram (a) of ideal voltage waveforms and a timing diagram (b) of physical voltage waveforms of the present invention.

Refer to FIG. 9 a block diagram showing a data-electrode driver according to the present invention, wherein the potential generator outputting five different potentials V1, V2, V3, V4 and V5 is used for exemplification. The data-electrode driver 34 of the present invention comprises: a latch register circuit 341, a switch control circuit 342, a detection-count circuit 345, a voltage level shifter 343 and a driver output circuit 344, Via horizontal synchronous signals, the latch register circuit 341 temporarily stores display data line by line and sends them to the switch control circuit 342. The switch control circuit 342 processes the alternating driving signals (M), pulse width modulation signals (PWM), frame rate control signals (FRC) and display data into switch control signals. The detection-count circuit 345 detects the switch control signals. When a switch control signal does not change during a scanning period, the detection-count circuit 345 increases the count by one. The detection-count circuit 345 calculates the number of waiting voltage offsets of each one of the data electrodes X1, X2, . . . , Xn and converts the number of waiting voltage offsets into an offset time 100 and shifts the data electrode X1, X2, . . . , or Xn to an intermediate potential during the offset time 100. Refer to FIG. 10 for a timing diagram (a) of ideal voltage waveforms and a timing diagram (b) of physical voltage waveforms of the present invention, wherein the offset time 100 is proportional to the number of waiting voltage offsets.

The voltage level shifter 343 converts the digital switch control signals into signals able to control switches and outputs the signals able to control switches to the driver output circuit 344. The driver output circuit 344 receives the signals from the voltage level shifter 343 and outputs the signals to data electrodes X1, X2, . . . , Xn via switch devices 3441 to form data-electrode signals needed by an LCD panel 15. In FIG. 9, as the switch device 3441 controls the potentials V2, V3 and V4, each switch device 3441 has three switches.

Figure 1:
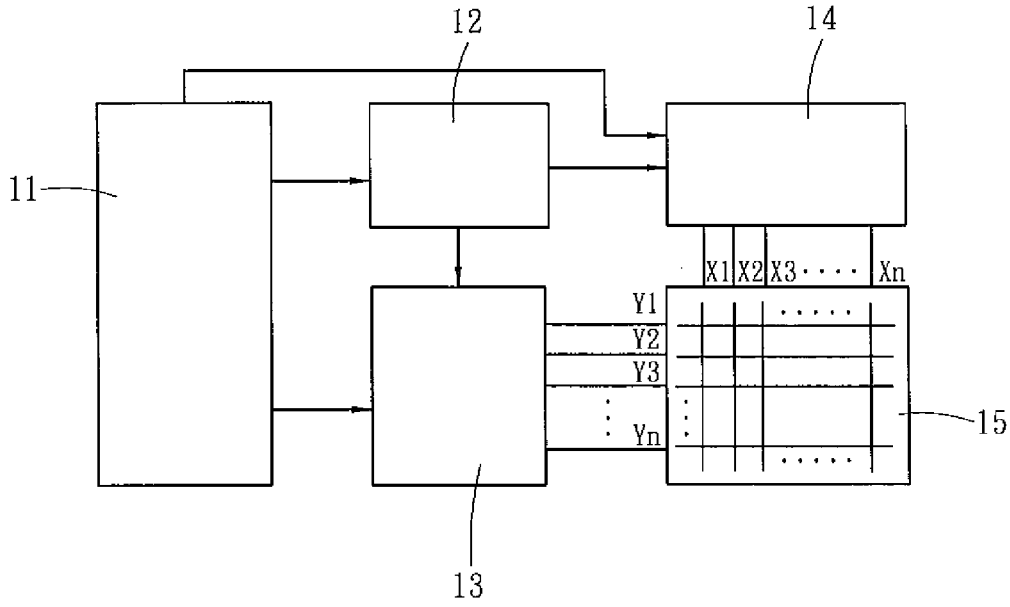
Fig. 1 PRIOR ART
FIG. 1 is a block diagram showing a conventional LCD driver circuit.
Figure 2:
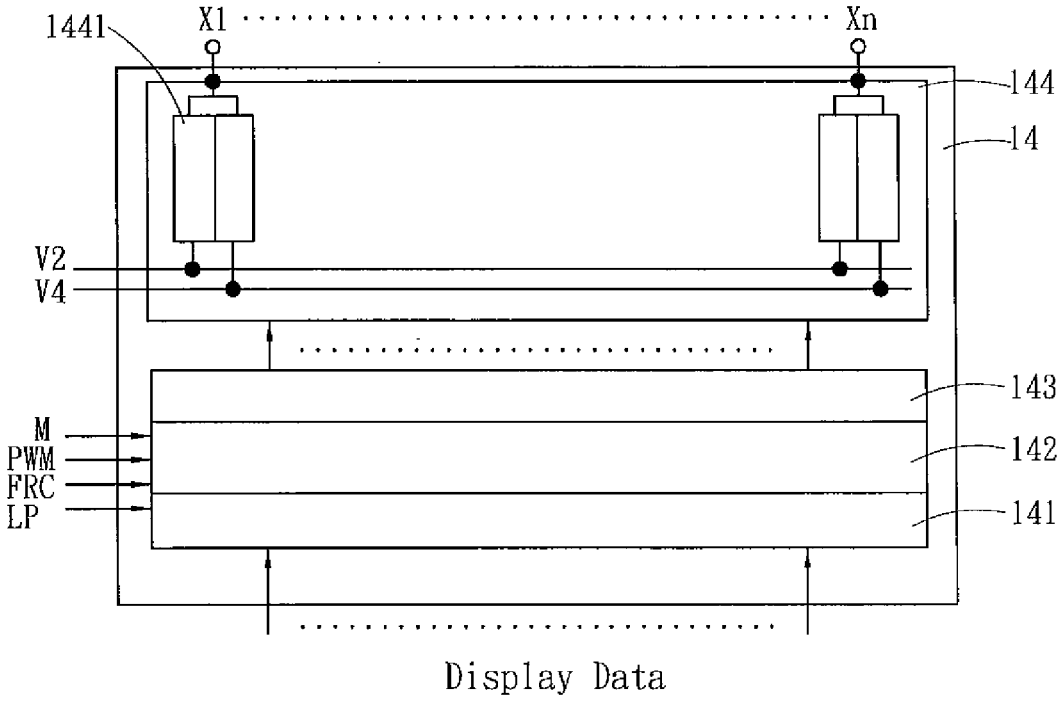
Fig. 2 PRIOR ART
FIG. 2 is a block diagram showing the data-electrode driver circuit in FIG. 1.
Figure 3:
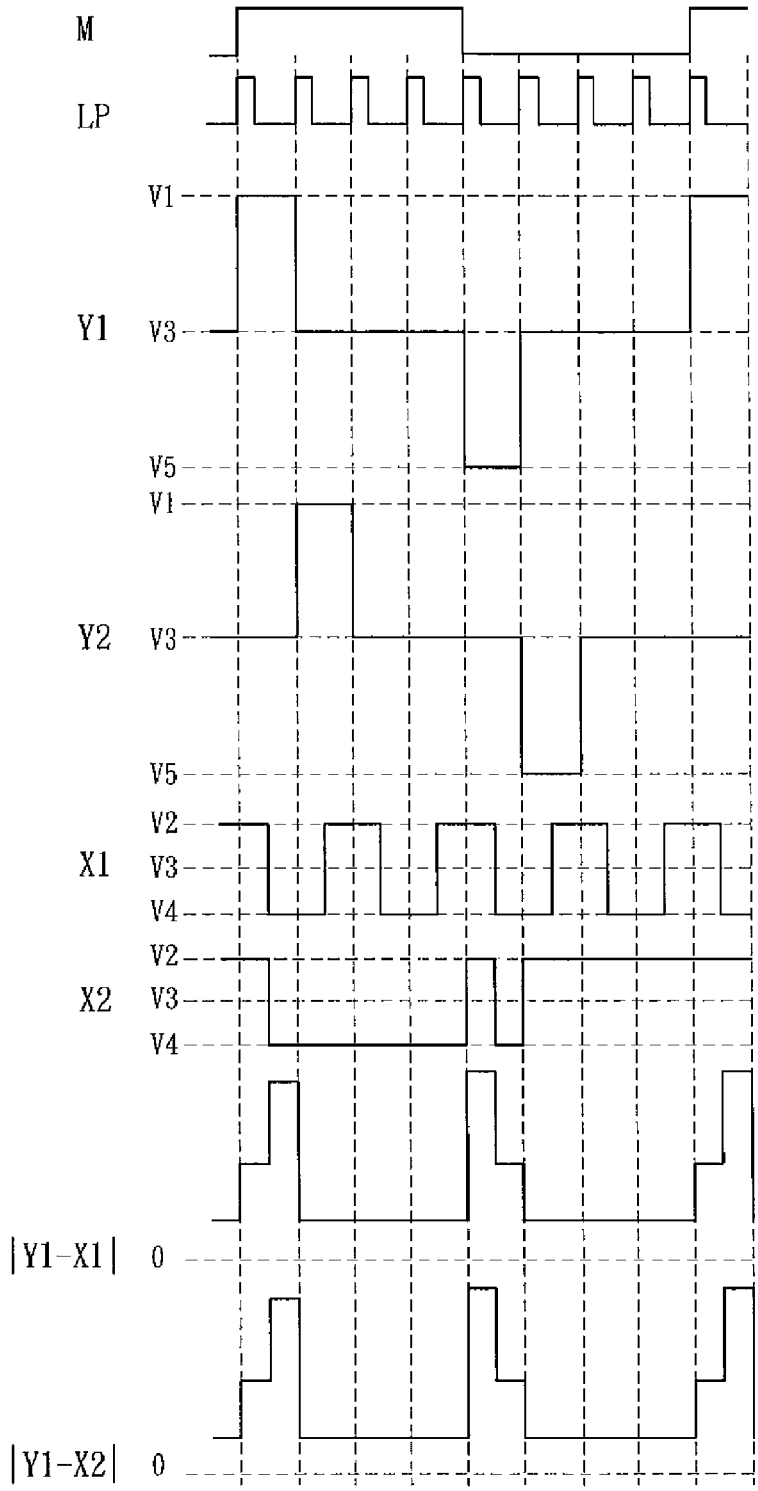
Fig. 3 PRIOR ART
FIG. 3 is a timing diagram of ideal voltage waveforms of a 2×4 liquid crystal matrix.
Figure 4:
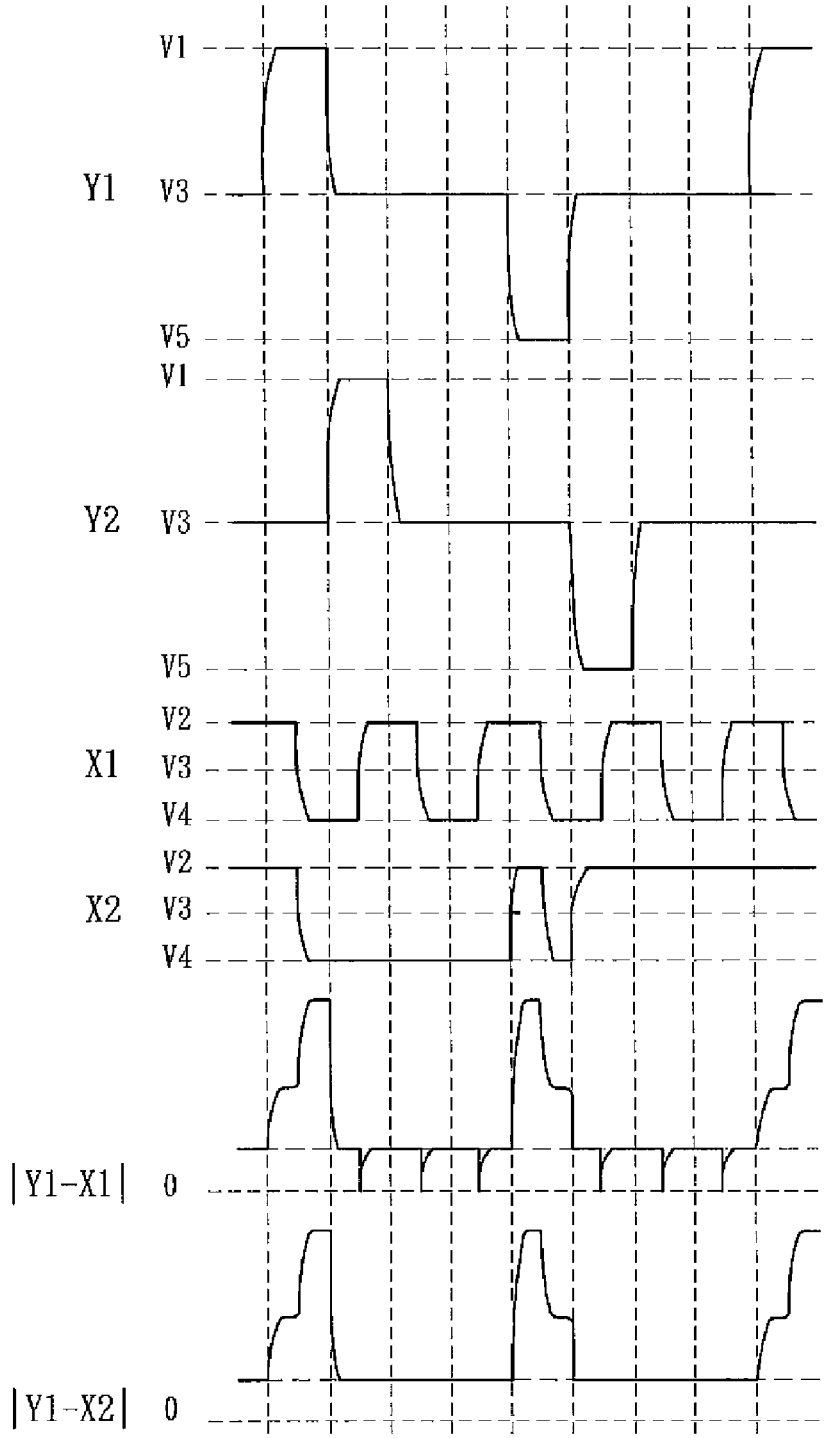
Fig. 4 PRIOR ART
FIG. 4 is a timing diagram of physical voltage waveforms of a 2×4 liquid crystal matrix.
Figure 5:
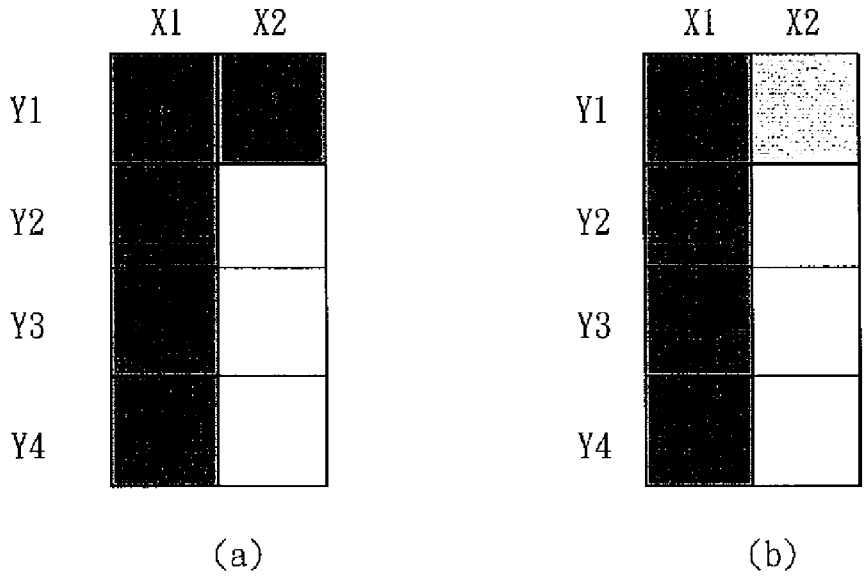
Fig . 5 PRIOR ART
FIG. 5 is a diagram schematically showing an ideal presentation (a) and a physical presentation of a 2×4 liquid crystal matrix.
Figure 6:
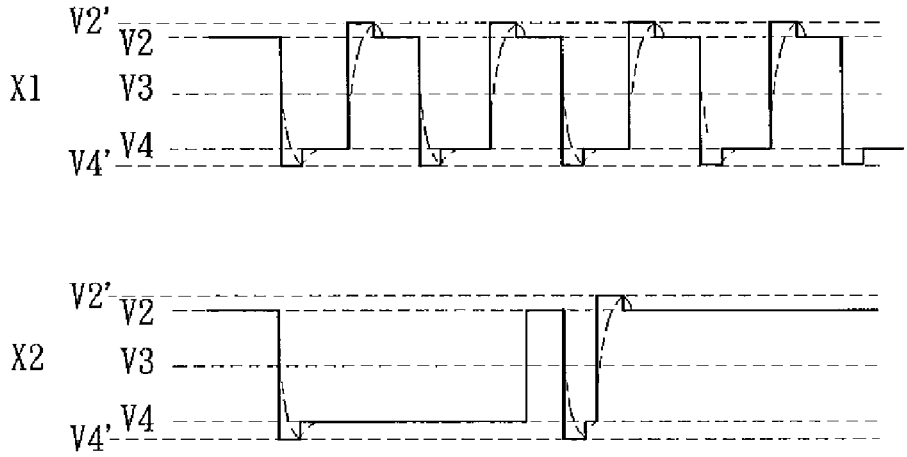
Fig . 6 PRIOR ART
FIG. 6 is a timing diagram showing the data electrode is beforehand shifted to a higher/lower potential when the potential of the data electrode is intended to shift.
Figure 7:
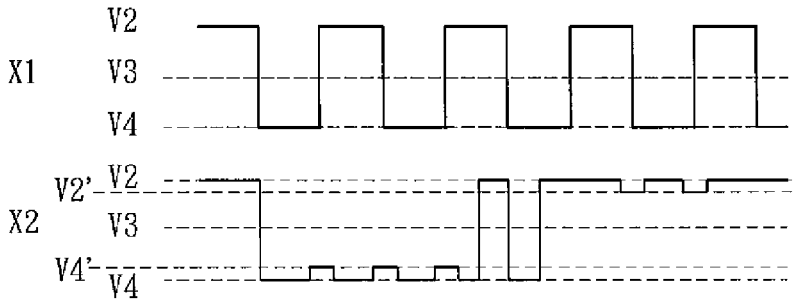
Fig . 7 PRIOR ART
FIG. 7 is a timing diagram showing the data electrode is beforehand shifted to a lower/higher potential when the potential of the data electrode is intended to shift.
Figure 8:
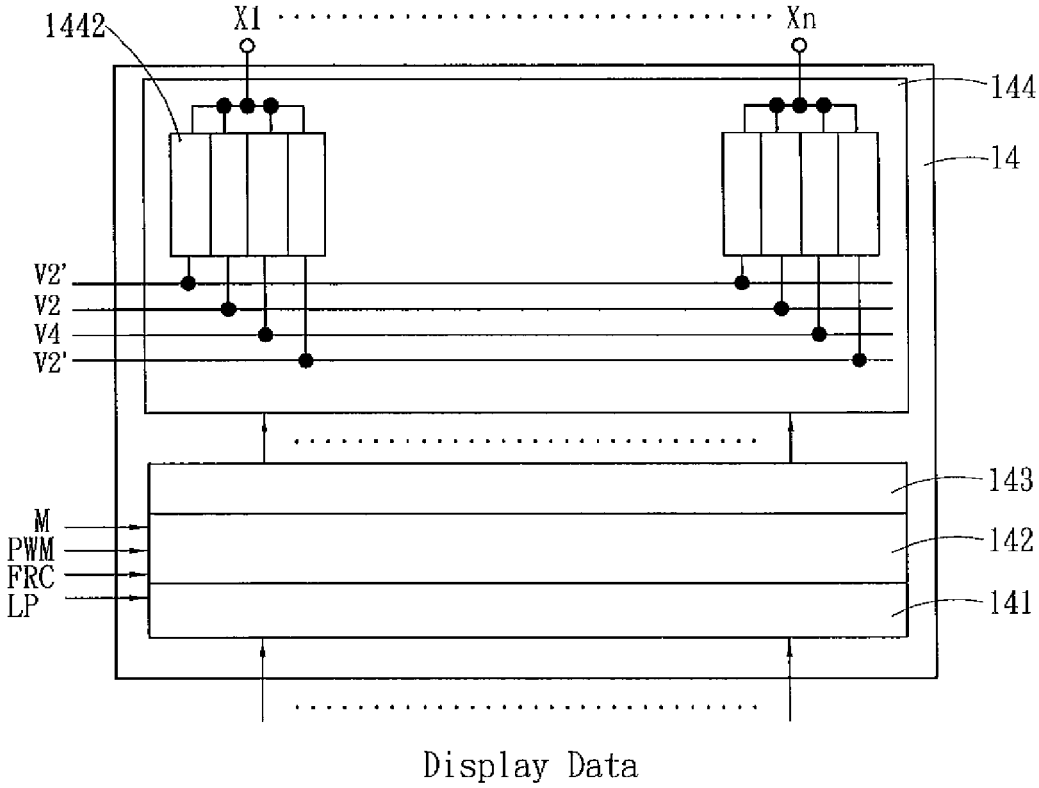
Fig . 8 PRIOR ART
FIG. 8 is a block diagram showing a data-electrode driver circuit to realize the waveforms in FIG. 6 and FIG. 7.

Similarly to the description of the conventional technologies, the present invention also uses a 2×4 liquid crystal matrix (shown in FIG. 5) for exemplification. Suppose V2-V3=V3-V4 and V1-V3=V3-V5. When the scanning electrodes Y1 and Y2 are at Potential V3, the RMS of the voltage differences of the scanning electrodes Y1 and Y2 and the data electrodes X1 and X2 will be identical in an ideal condition no matter what width the waveforms of the data electrodes X1 and X2 are, as shown in the timing diagram (a) of FIG. 10. In other words, the gray level presented in the pixels of the liquid matrix has nothing to do with the waveform width of the data electrodes X1 and X2.

Refer to the timing diagram (b) of FIG. 10. Considering the resistances and capacitances exist in an LCD panel, which distort the driving waveforms, the display data of the data electrodes X1 and X2 will mutually interfere when the scanning electrodes Yl.about.Y4 are at Potential V3. In the present invention, the detection-count circuit 345 calculates the number of waiting voltage offsets of each one of the data electrodes X1 and X2 (For example, the number of waiting voltage offsets is 3 in FIG. 10.) during a scanning period (Frame, FRM) and converts the number of waiting voltage offsets into an offset time 100 and shifts the data electrodes to an intermediate potential during the offset time 100. The offset time 100 is proportional to the number of waiting voltage offsets. After offset is completed, the data electrode is shifted to a potential for the next piece of data. Therefore, the effective voltage applied to the pixels of the liquid crystal matrix will not vary with the display data. Thus, the brightness non-uniformity resulting from waveform distortion can be eliminated. Further, decreasing the number of voltage changes is equal to decreasing the number of offsets, and the power consumption in data electrodes is also decreased.

The present invention may adopt a potential generated by the original potential generator as an intermediate potential. In the case that the potential generator outputs five different potentials V1, V2, V3, V4 and V5, Potential V3 may be used as the intermediate potential. Therefore, the present invention does not need additional offset potential. Thereby, the complexity of the power supply can be reduced, and the number of the switches used in each data electrode of the present invention is less by one than that used in the conventional technology (Each switch device 3441 needs only three switches). Further, as the number of offsets (the number of voltage changes) is decreased, the power consumption in the data electrodes X1, X2, . . . , Xn is reduced. Furthermore, the present invention can reduce effective voltage loss and contrast degradation to the minimum and can more precisely offset the loss resulting from voltage shifts. Moreover, the deep sub-micron technology can greatly reduce the cost of the detection-count circuit 345, and the gain of the detection-count circuit 345 thus far outweighs the cost thereof.

Those described above are only the preferred embodiments to exemplify the present invention but not to limit the scope of the present invention. Any equivalent modification or variation according to the spirit of the present invention is to be also included within the scope of the present invention.

What is claimed is:

1. A liquid crystal display driver for improving brightness uniformity, which is a data-electrode driver outputting display data to a liquid crystal display panel, comprising:

a latch register circuit temporarily storing display data line by line and sending out said display data;

a switch control circuit receiving said display data from said latch register circuit and processing said display data into switch control signals;

a detection-count circuit detecting said switch control signals, increasing the count by one when a scanning electrode being at a non-selection potential and said switch control signal does not change during a scanning period and not increasing the count when said switch control signal does change during said scanning period, calculating a number of waiting voltage offsets of each one of data electrodes, converting said number of waiting voltage offsets into an offset time, and shifting said data electrode to an intermediate potential during said offset time;

a voltage level shifter converting said switch control signals, which have passed through said detection-count circuit, from digital signals into signals able to control switches; and a driver output circuit receiving said signals able to control switches from said voltage level shifter and outputting data-electrode signals via switch devices.

2. The liquid crystal display driver for improving brightness uniformity according to claim 1, wherein said offset time is proportional to said number of waiting voltage offsets.

3. A method for improving brightness uniformity of a liquid crystal display, which is a method for outputting display data to a data-electrode driver of a liquid crystal display panel, comprising:

using a detection-count circuit to detect a switch control signal, increase the count by one when a scanning electrode being at a non-selection potential and said switch control signal does not change during a scanning period and not increase the count when said switch control signal does change during said scanning period, calculate a number of waiting voltage offsets of each one of data electrodes during said scanning period, convert said number of waiting voltage offsets into an offset time, shift a data electrode to an intermediate potential during said offset time, and shift said data electrode to a potential for a next piece of data after said offset time is over.

4. The method for improving brightness uniformity of the liquid crystal display according to claim 3, wherein said offset time is proportional to said number of waiting voltage offsets.

* * * * *